US005276488A

United States Patent [19]

Schmidlin

[11] Patent Number: 5,276,488

[45] Date of Patent: Jan. 4, 1994

[54] DONOR BELT AND ELECTRODE STRUCTURE SUPPORTED BEHIND THE BELT FOR DEVELOPING ELECTROSTATIC IMAGES WITH TONER

[75] Inventor: Fred W. Schmidlin, Pittsford, N.Y.

[73] Assignee: Xerox Corporation, Stamford, Conn.

[21] Appl. No.: 937,003

[22] Filed: Aug. 31, 1992

[51] Int. Cl.[5] ..... G03G 15/08

[52] U.S. Cl. ..... 355/247; 118/654; 355/245; 355/326

[58] Field of Search ..... 355/245-247, 251, 253, 259, 261, 326, 328; 118/645, 647, 653, 654, 656-658

[56] References Cited

U.S. PATENT DOCUMENTS

| | | | |
|---|---|---|---|
| 3,376,852 | 4/1968 | Weiler | 118/647 |
| 3,457,900 | 7/1969 | Drexler | 118/637 |
| 3,900,001 | 8/1975 | Fraser et al. | 118/637 |
| 3,914,460 | 10/1975 | Maksymiak | 427/14 |
| 3,997,460 | 12/1976 | Sirine et al. | 252/106 |
| 3,997,688 | 12/1976 | Gundlach | 427/25 |
| 4,078,929 | 3/1978 | Gundlach | 96/1.2 |
| 4,308,821 | 1/1982 | Matsumoto et al. | 118/645 |
| 4,478,505 | 10/1984 | Tashiro | 355/245 |
| 4,486,089 | 12/1984 | Itaya et al. | 355/251 |
| 4,568,955 | 2/1986 | Hosoya et al. | 346/153.1 |
| 4,637,708 | 1/1987 | Yuasa | 355/245 X |
| 4,656,427 | 4/1987 | Dauphinee | 324/444 |
| 4,810,604 | 3/1989 | Schmidlin | 430/42 |
| 4,833,504 | 5/1989 | Parker et al. | 355/326 |
| 4,868,600 | 9/1989 | Hays et al. | 355/259 |
| 5,010,367 | 4/1991 | Hays | 355/247 |
| 5,040,004 | 8/1991 | Schmidlin et al. | 355/259 X |

*Primary Examiner*—R. L. Moses
*Assistant Examiner*—William J. Royer

[57] ABSTRACT

A scavengeless development system in which toner is detached from a donor belt and attracted to latent electrostatic images carried by an image receiver positioned adjacent the belt. Generation of a controlled powder cloud of toner particles is effected using AC electric fields created by applying an AC voltage to an embedded electrode structure stationarily positioned behind the donor belt. Unused toner is removed from the donor belt in a manner which avoids history effects due to accumulation of highly charged, relatively small toner particles on the donor belt.

12 Claims, 2 Drawing Sheets

DONOR BELT AND ELECTRODE STRUCTURE SUPPORTED BEHIND THE BELT FOR DEVELOPING ELECTROSTATIC IMAGES WITH TONER

BACKGROUND OF THE INVENTION

This invention relates generally to the rendering of latent electrostatic images visible. More particularly, the invention relates to noninteractive or scavengeless development systems.

The invention can be utilized in the art of xerography or in the printing arts. In the practice of conventional xerography, it is the general procedure to form electrostatic latent images on a xerographic surface by first uniformly charging a photoreceptor. The photoreceptor comprises a charge retentive surface. The charge is selectively dissipated in accordance with a pattern of activating radiation corresponding to original images. The selective dissipation of the charge leaves a latent charge pattern on the imaging surface corresponding to the areas not exposed by radiation.

This charge pattern is made visible by developing it with toner. The toner is generally a colored powder which adheres to the charge pattern by electrostatic attraction.

The developed image is then fixed to the imaging surface or is transferred to a receiving substrate such as plain paper to which it is fixed by suitable fusing techniques.

The present invention is especially suited for use in highlight color printing systems. One form, tri-level imaging, of highlight color imaging described in U.S. Pat. No. 4,078,929 issued in the name of Gundlach. The patent Gundlach teaches the use of tri-level xerography as a means to achieve single-pass highlight color imaging. As disclosed therein the charge pattern is developed with toner particles of first and second colors. The toner particles of one of the colors are positively charged and the toner particles of the other colors are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

In highlight color xerography as taught by Gundlach, the xerographic contrast on the charge retentive surface or photoreceptor is divided three, rather than two, ways as is the case in conventional xerography. The photoreceptor is charged, typically to 900 v. It is exposed imagewise, such that one image corresponding to charged image areas (which are subsequently developed by charged-area development, i.e. CAD) stays at the full photoreceptor potential ($V_{cad}$ or $V_{ddp}$). The other image is exposed to discharge the photoreceptor to its residual potential, i.e. $V_{dad}$ or $V_c$ (typically 100 v) which corresponds to discharged area images that are subsequently developed by discharged-area development (DAD) and the background areas exposed such as to reduce the photoreceptor potential to halfway between the $V_{cad}$ and $V_{dad}$ potentials, (typically 500 v) and is referred to as $V_{white}$ or $V_w$. The CAD developer is typically biased about 100 v closer to $V_{cad}$ than $V_{white}$ (about 600 v), and the DAD developer system is biased about 100 v closer to $V_{dad}$ than $V_{white}$ (about 400 v).

The viability of printing system concepts such as tri-level, highlight color xerography requires development systems that do not scavenge or interact with a previously toned image. Since commercial development systems such as magnetic brush development and jumping single component development interact with the image receiver, a previously toned image will be scavenged by subsequent development. Great care is required to optimize the development materials and process conditions for minimum interaction. Since the present commercial development systems are highly interactive with the image bearing member, there is a need for scavengeless or non-interactive development systems.

It is known in the art to alter the magnetic properties of the magnetic brush in the second housing in order to obviate the foregoing problem. For example, there is disclosed in U.S. Pat. No. 4,308,821 granted on Jan. 5, 1982 to Matsumoto et al, an electrophotographic development method and apparatus using two magnetic brushes for developing two-color images which do not disturb or destroy a first developed image during a second development process. This is because a second magnetic brush contacts the surface of a latent electrostatic image bearing member more lightly than a first magnetic brush and the toner scraping force of the second magnetic brush is reduced in comparison with that of the first magnetic brush by setting the magnetic flux density on a second non-magnetic sleeve with an internally disposed magnet smaller than the magnetic flux density on a first magnetic sleeve, or by adjusting the distance between the second non-magnetic sleeve and the surface of the latent electrostatic image bearing members. Further, by employing toners with different quantity of electric charge, high quality two-color images are obtained.

U.S. Pat. No. 3,457,900 discloses the use of a single magnetic brush for feeding developer into a cavity formed by the brush and an electrostatic image bearing surface faster than it is discharged thereby creating a roll-back of developer which is effective in toning an image. The magnetic brush is adapted to feed faster than it discharges by placement of strong magnets in a feed portion of the brush and weak magnets in a discharge portion of the brush.

U.S. Pat. No. 3,900,001 discloses an electrostatographic developing apparatus utilized in connection with the development of conventional xerographic images. It is utilized for applying developer material to a developer receiving surface in conformity with an electrostatic charge pattern wherein the developer is transported from the developer supply to a development zone while in a magnetic brush configuration and thereafter, transported through the development zone in magnetically unconstrained blanket contact with the developer receiving surface.

As disclosed in U.S. Pat. No. 4,486,089 granted on Dec. 4, 1984 to Itaya, et. al. a magnetic brush developing apparatus for a xerographic copying machine or electrostatic recording machine has a sleeve in which a plurality of magnetic pieces are arranged in alternating polarity. Each piece has a shape which produces two or more magnetic peaks. The sleeve and the magnets are rotated in opposite directions. As a result of the above, it is alleged that a soft developer body is obtained, and density unevenness or stripping of the image is avoided.

U.S. Pat. No. 4,833,504 granted to Parker et al on May 23, 1989 discloses a magnetic brush developer apparatus comprising a plurality of developer housings each including a plurality of magnetic rolls associated therewith. The magnetic rolls disposed in a second developer housing are constructed such that the radial component of the magnetic force field produces a magnetically free development zone intermediate a charge retentive surface and the magnetic rolls. The developer is moved through the zone magnetically unconstrained and, therefore, subjects the image developed by the first developer housing to minimal disturbance. Also, the developer is transported from one magnetic roll to the next. This apparatus provides an efficient means for developing the complimentary half of a tri-level latent image while at the same time allowing the already developed first half to pass through the second housing with minimum image disturbance.

U.S. Pat. No. 4,810,604 granted to Frederick W. Schmidlin on Mar. 30, 1987 discloses a combination Xerographic-DEP printing apparatus wherein highlight color images are formed without scavenging and re-development of a first developed image. A first image is formed in accordance with conventional (i.e. total voltage range available) electrostatic image forming techniques. A successive image is formed on the copy substrate containing the first image subsequent to first image transfer, either before or after fusing, by utilization of direct electrostatic printing. Thus, the 604 patent solves the problem of developer interaction with previously recorded images by forming a second image on the copy substrate instead of on the charge retentive surface on which the first image was formed.

U.S. Pat. No. 4,478,505 issued on Oct. 23, 1984 relates to developing apparatus for improved charging of flying toner. The apparatus disclosed therein comprises a conveyor for conveying developer particles from developer supplying means and a photoconductive body positioned to define a gap therebetween. A developer supplying passage for conveying developer particles is provided between the developer supplying means and the gap. The developer supplying passage is defined by the conveyor and an electrode plate provided with a predetermined interval with the conveyor. An alternating electric field is applied to the developer supplying passage by an A.C. power source to reciprocate the developer particles between the conveyor and the electrode plate thereby sufficiently and uniformly charging the developer particles by friction. In the embodiment disclosed in FIG. 6 of the '505 patent, a grid is disposed in a space between the photosensitive layer and a donor member.

U.S. Pat. No. 4,568,955 issued on Feb. 4, 1986 to Hosoya et al discloses a recording apparatus wherein a visible image based on image information is formed on an ordinary sheet by a developer. The recording apparatus comprises a developing roller spaced at a predetermined distance from and facing the ordinary sheet and carrying the developer thereon, a recording electrode and a signal source connected thereto, for propelling the developer on the developing roller to the ordinary sheet by generating an electric field between the ordinary sheet and the developing roller according to the image information, a plurality of mutually insulated electrodes provided on the developing roller and extending therefrom in one direction, an A.C. and a D.C. source are connected to the electrodes, for generating an alternating electric field between adjacent ones of the electrodes to cause oscillations of the developer found between the adjacent electrodes along electric lines of force therebetween to thereby liberate the developer from the developing roller.

U.S. Pat. No. 4,656,427 granted to Hosaka et al on Mar. 31, 1987 discloses a method and apparatus wherein a layer of developer which is a mixture of insulative, magnetic particles and insulative toner particles is carried on the surface of a developer sleeve forming part of a magnetic brush. A latent image bearing member carrying an image to be developed is moved relative to the magnetic brush. The brush is spaced from the image bearing member and an AC field is formed across the space to effect toner transfer to the image and non-image areas and to effect a back transfer of excessive toner.

Japanese Publication 62-70881 discloses a toner separating means using a plurality of electrically biased grid wires disposed intermediate a magnet brush developer roll and an imaging surface. The two-component developer is triboelectrified and magnetic carrier is removed from the outer periphery of a sleeve by the action of the north and south poles of the magnetic poles of the magnetic brush.

U.S. Pat. No. 4,868,600 granted to Hays et al on Sep. 19, 1989 discloses a scavengeless development system in which toner detachment from a donor and the concomitant generation of a controlled powder cloud is obtained by AC electric fields supplied by self-spaced electrode structures positioned within a development nip. The electrode structure is placed in close proximity to the toned donor within the gap or nip between the toned donor and image receiver, self-spacing being effected via the toner on the donor. Such spacing enables the creation of relatively large electrostatic fields without risk of air breakdown.

U.S. Pat. No. 5,010,367 granted to Dan A. Hays on Apr. 23, 1991 discloses a scavengeless/non-interactive development system for use in highlight color imaging. To control the developability of lines and the degree of interaction between the toner and receiver, the combination of an AC voltage on a developer donor roll with an AC voltage between toner cloud forming wires and donor roll enables efficient detachment of toner from the donor to form a toner cloud and position one end of the cloud in close proximity to the image receiver for optimum development of lines and solid areas without scavenging a previously toned image.

U.S. patent application Ser. No. 07/724,242 filed on Jul. 1, 1991 in the name of Dan A. Hays and assigned to the same assignee as the instant application discloses a scavengeless or non-interactive development system for use in image formation such as highlight color imaging. A toned donor roll structure having two sets of interdigitated electrodes physically supported by an insulative support structure is provided. One set of electrodes has a DC bias applied thereto while the other set has an AC bias applied thereto. The AC and DC biases are such as to preclude background development without creating fringe DC fields between adjacent electrodes.

U.S. Pat. No. 3,997,688 granted to Gundlach et al on Dec. 14, 1976 discloses a xerographic imaging process wherein a positive charge image on the surface of a photoconductor is developed using a blade shaped conductor and a non-conductive and flexible donor sheet having on one side a negatively charged toner layer. The donor sheet is mounted such that the layer is spaced from but near the surface of the photoconductor and the conductor is mounted such that its edge slidably abuts the other side of the donor sheet in the region where the sheet is nearest the photoconductor. As a result, the part of the image nearest the edge establishes a non-uniform electrical field between the image and the edge. The non-uniform field is strongest in the region nearest the edge and causes the transfer of toner from the layer to the photoconductor. In one embodiment the donor sheet is in the form of a belt which is driven so that it slides over the edge. The photoconductor is placed on the surface of a rotatable drum and as the drum is rotated the image is developed. Means are provided for replenishing the toner used during development. In another embodiment the donor sheet and photoconductor are supported in parallel and the conductor is moved across said other side of the donor sheet to develop the image.

U.S. Pat. No. 3,914,460 granted on Oct. 21, 1975 to John Maksymiak discloses a shaped electric field acting on a toner laden donor member for separating toner from the donor member as it enters a development zone and for redepositing any excess toner on the donor member as it leaves the development zone.

U.S. Pat. No. 3,997,460 granted to Gundlach et al on Dec. 14, 1976 discloses xerographic apparatus wherein a positive charge image on the surface of a photoconductor is developed with a blade shaped conductor, and a non-conductive and flexible donor sheet having on one side a negatively charged toner layer. The donor sheet is mounted such that the layer is spaced from but near the surface of the photoconductor, and the conductor is mounted such that its edge slidably abuts the other side of the donor sheet in the region where the sheet is nearest the photoconductor. As a result, the part of the image nearest the edge establishes a non-uniform electrical field between the image and the edge. The non-uniform field is strongest in the region nearest the edge and causes the transfer of toner from the layer to the photoconductor. In one embodiment the donor sheet is in the form of a belt which is driven so that it slides over the edge. The photoconductor is placed on the surface of a rotatable drum and as the drum is rotated the image is developed. Means are provided for replenishing the toner used during development. In another embodiment the donor sheet and photoconductor are supported in parallel and the conductor is moved across the other side of the donor sheet to develop the image.

Wires contacting a toner layer on a donor roll is proven method of scavengeless xerographic development. The wires are problematic, in that, they are difficult to mount in a consistent reproducible manner and they are prone to contamination from agglomerates or debris. Such contamination results in banding and streaks on the output copies.

Stable toners layers on a donor roll are also difficult to achieve. To avoid the history effects due to the accumulation of highly charged, small toner particles on the donor, unused toner should be continuously removed followed by freshly deposited toner. The toner can be scraped from the donor with a blade but this forces the effective toner throughput to levels beyond the capacity of small sump development systems. Stressed development manifests itself by degradation of the toner charge distribution and the appearance of background density. Brush cleaners also can not handle high throughput and keeping the brush clean is difficult and complicated.

BRIEF SUMMARY OF THE INVENTION

Briefly, the present invention uses a scavengeless development system in which toner detachment from a donor belt is effected using at least a pair of electrodes stationarily supported behind the belt. An AC voltage applied to the electrodes serves to liberate toner from the surface of the belt to form a cloud of toner particles. The belt and a latent image receiver are positioned relatively to each other for delineating a development nip. Latent electrostatic images on the image receiver attract toner particles from the cloud of such particles in the nip.

A brush development electrode positioned with the loop of the donor belt serves as a brush development electrode while a brush cleaner electrode, also disposed within the loop delineated by the belt, serves to remove unused toner from the belt in order to avoid history effects.

DETAILED DESCRIPTION OF THE PREFERRED EMBODIMENT OF THE INVENTION

Figure 2:
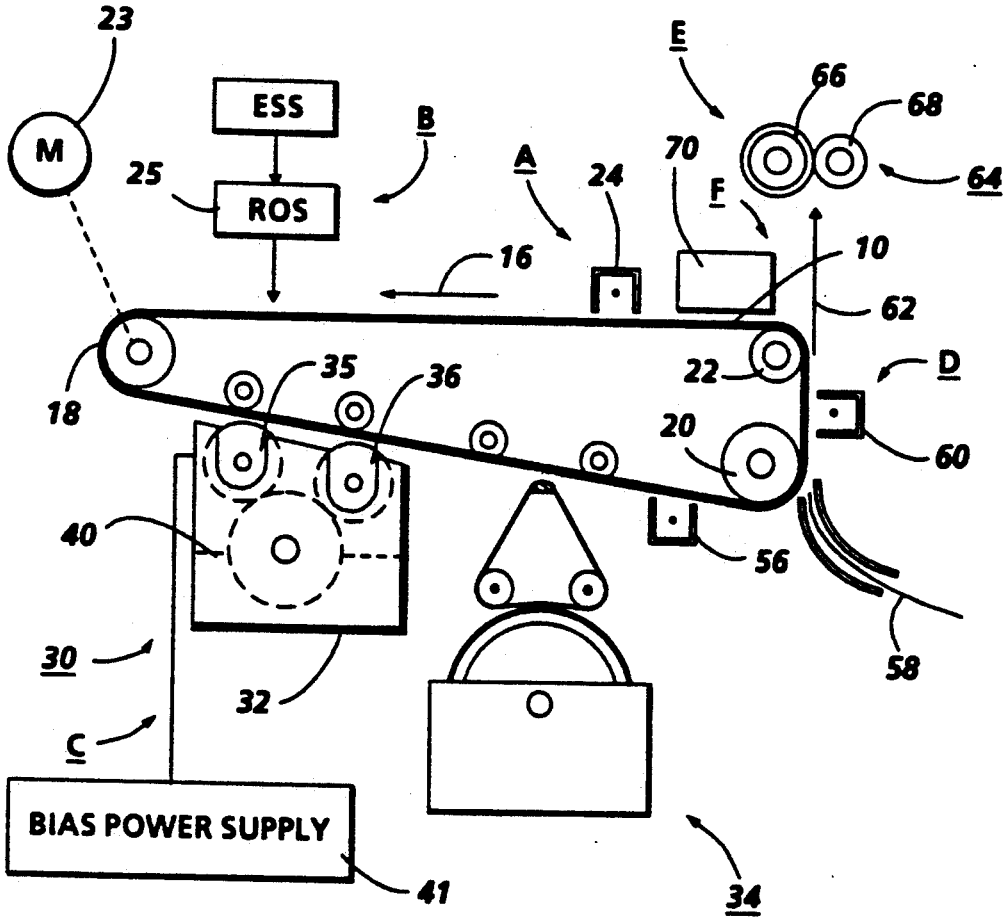
FIG. 2 is a fragmentary schematic illustration of a developer apparatus according to the present invention.

As shown in FIG. 2, a printing machine incorporating the invention may utilize a charge retentive member in the form of a photoconductive belt 10 consisting of a photoconductive surface and an electrically conductive substrate and mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 2, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, $V_0$. Preferably charging is negative. Any suitable control, well known in the art, may be employed for controlling the corona discharge device 24.

Next, the charged portions of the photoreceptor surface are advanced through exposure station B. At exposure station B, the uniformly charged photoreceptor or charge retentative surface 10 is exposed to a laser based input and/or output scanning device 25 which causes the charge retentive surface to be discharged in accordance with the output from the scanning device. Preferably the scanning device is a three level laser Raster Output Scanner (ROS). Alternatively, the ROS could be replaced by a conventional xerographic exposure device.

The photoreceptor, which is initially charged to a voltage $V_0$, undergoes dark decay to a level $V_{ddp}$ equal to about −900 volts. When exposed at the exposure station B it is discharged to $V_c$ equal to about −100 volts which is near zero or ground potential in the highlight (i.e. color other than black) color parts of the image. The photoreceptor is also discharged to $V_w$ equal to −500 volts imagewise in the background (white) image areas.

At development station C, a development system, indicated generally by the reference numeral 30 advances developer materials into contact with the electrostatic latent images. The development system 30 comprises first and second developer apparatuses 32 and 34. The developer apparatus 32 comprises a housing containing a pair of magnetic brush rollers 35 and 36. The rollers advance developer material 40 into contact with the latent images on the charge retentive surface which are at the voltage level $V_c$. The developer material 40 by way of example contains red toner. Appropriate electrical biasing is accomplished via power supply 41 electrically connected to developer apparatus 32. A DC bias of approximately 400 volts is applied to the rollers 35 and 36 via the power supply 41.

The developer apparatus 34 (FIG. 2) comprises a donor structure in the form of a belt 42. The donor structure 42 conveys charged toner particles 44 deposited thereon to a development zone 46 where the toner particles are formed into a toner cloud for selective deposition on images contained on the charge retentive surface. The developer in this case comprises black toner. Further details of the developer apparatus 34 will be provided hereinbelow.

A sheet of support material 58 (FIG. 2) is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack copy sheets. Feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station D.

Because the composite image developed on the photoreceptor consists of both positive and negative toner, a positive pre-transfer corona discharge member 56 is provided to condition the toner for effective transfer to a substrate using negative corona discharge.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed by cleaning apparatus 70 at cleaning station F. A magnetic brush cleaner housing is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush.

Subsequent to cleaning, a discharge lamp (not shown) floods the photoconductive surface with light to dissipate any residual electrostatic charge remaining prior to the charging thereof for the successive imaging cycle.

Figure 1:
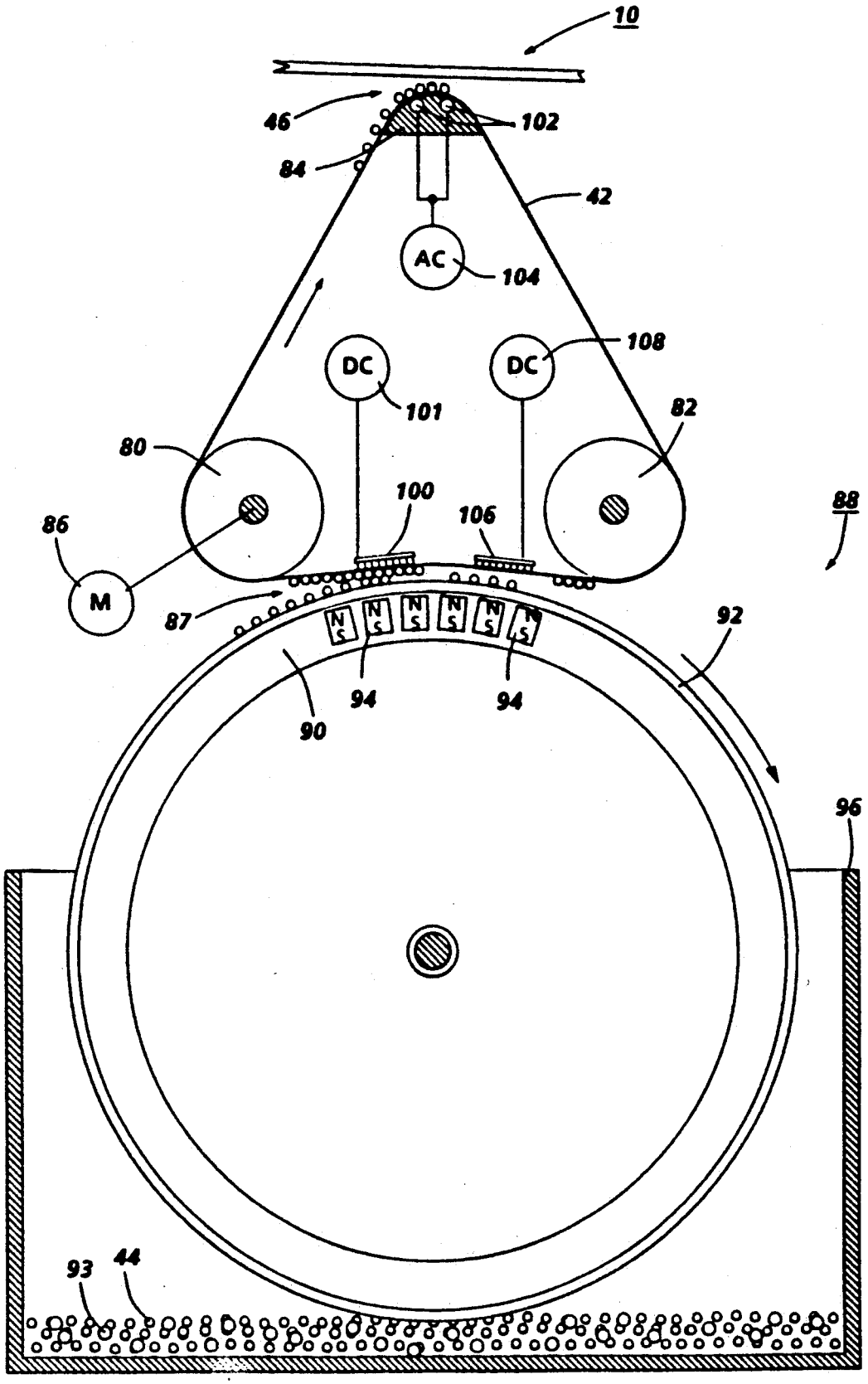
FIG. 1 is a schematic illustration of a printing apparatus incorporating the inventive features of our invention.

As illustrated in FIG. 1, the donor belt 42 is supported for movement through the development zone 46 (i.e. space between the charge retentive surface and the donor belt) by a drive roll 80, idler roll 82 and a development shoe 84. The drive roller 80 is driven via a drive motor 86 operatively connected thereto in a well know manner. The spacing or gap between the charge retentive surface and the donor belt is in the order of 5–20 mils. The belt 42 is a seamless construction and preferably has a thickness of 1 to 3 mils and is fabricated from carbon loaded Tedlar or Kapton (Trademarks of E.I. duPont de Nemours & Co.) having a resistivity of the order of $10^7$ ohm-cm.

Charged toner particles are conveyed to a loading zone 87 using a magnetic brush device 88 which comprises a stationary magnet assembly 90 and a rotatable sleeve 92. The stationary magnet assembly comprises a plurality of alternately polarized pole pieces 94. A two component developer comprising carrier beads 93 and toner particles 44 is contained in a supply sump 96 from which it is conveyed by the sleeve 92 to the loading zone 87.

A conductive brush development electrode 100 positioned behind the donor belt 42 serves to effect deposition of charged toner particles onto the donor belt. To this end, when negatively charged toner is utilized, a positive DC voltage in the order of 200 to 400 volts provided by a DC voltage source 101 is applied to the conductive brush 100. The toner particles are conveyed by the belt to the development zone 46 where the toner particles are formed into a toner cloud for effecting scavengeless development of latent electrostatic images on the charge retentive surface. An AC voltage in the order of 600–800 volts peak depending upon the belt thickness is applied to a pair of electrodes 102 electrodes by an AC voltage source 104. The electrodes are embedded in the development shoe 84 which is fabricated from a dielectric material or otherwise structured to electrically isolate the electrodes 102.

A conductive brush cleaning electrode 106 also disposed inside the loop formed by the donor belt 42 serves to repel unused toner particles from the donor belt back onto the sleeve 92. The conductive cleaning brush 106 is electrically biased using a DC voltage source 108 to a negative voltage in the order of −200 to −400 volts. Such removal of toner from the donor belt is followed by a fresh deposit of toner by the development electrode 100. Thus, a stable toner layer on a donor roll is provided which avoids the history effects due to the accumulation of highly charged, small toner particles on the donor.

While the developer apparatus 32 has been disclosed as a magnetic brush system, developer apparatus 34 could be used in its place. Also, while the development of discharged area images was discussed as being effected prior to charged area development the sequence of image development can be reversed.

What is claimed is:

1. Apparatus for developing latent electrostatic images on a charge retentive surface with toner, said apparatus comprising:

a supply of toner;

a donor belt structure spaced from said charge retentive surface for conveying toner from said supply of toner to a development zone intermediate said charge retentive surface and said donor belt structure;

means for supporting said belt for movement in an endless path whereby said belt delineates endless loop;

said supporting means including a development shoe having an electrode structure embedded therein, said development shoe being supported within said loop and in contact with said donor belt adjacent said development zone;

means for loading toner particles onto said donor belt structure in a loading zone; and.

electrical bias means for applying a voltage to said electrode structure for forming a cloud of toner particles in said development zone

2. Apparatus according to claim 1 including means for continuously removing unused toner particles from said donor belt prior to loading fresh toner onto said donor belt.

3. Apparatus according to claim 2 wherein said means for loading said toner particles onto said donor belt structure in a loading zone comprises a conductive development brush supported in contact with said belt within said loop and means for electrically biasing said conductive development brush for attracting charged toner particles to said belt from said loading means.

4. Apparatus according to claim 3 wherein said means for continuously removing unused toner particles from said donor belt prior to loading fresh toner onto said belt comprises a conductive cleaning brush contacting said belt within said loop and means for electrically biasing said cleaning brush for repelling toner particles from said donor belt.

5. Apparatus according to claim 4 wherein said electrical bias means for applying a voltage to said electrode structure comprises an AC voltage source.

6. Apparatus according to claim 5 wherein said electrical biases for electrically biasing said development and cleaning brushes comprise DC voltage sources having opposite polarities.

7. A method for developing latent electrostatic images on a charge retentive surface with toner, said method including the steps of providing a supply of toner;

using a donor belt structure positioned adjacent said charge retentive surface, conveying toner from said supply of toner to a development zone intermediate said charge retentive surface and said donor belt structure;

supporting said donor belt for movement in an endless path whereby said belt delineates and endless loop;

contacting said donor belt within said loop with a development shoe having an electrode structure embedded therein;

loading toner particles onto said donor belt structure in a loading zone; and electrically biasing said electrode structure for forming a cloud of toner particles in said development zone.

8. The method according to claim 7 including continuously removing unused toner particles from said donor belt prior to loading fresh toner onto said belt.

9. The method according to claim 8 wherein said loading of toner particles comprises electrically biasing a conductive development brush supported in contact with said belt within said loop for attracting charged toner particles to said belt from said loading means.

10. The method according to claim 9 wherein said continuous removal of unused toner particles from said donor belt prior to loading fresh toner onto said belt comprises electrically biasing a conductive cleaning brush contacting said belt within said loop.

11. The method according to claim 10 wherein said electrical biasing of said electrode structure comprises means for applying an AC voltage thereto.

12. The method according to claim 11 wherein said electrical biasing of said development and cleaning brushes comprises using DC voltage sources having opposite polarities.

* * * * *